United States Patent [19]

Adams, Jr. et al.

[11] Patent Number: 4,567,296

[45] Date of Patent: Jan. 28, 1986

[54] 1-FLUORO-1,1,5-TRINITRO-3-OXA-5-AZAHEXANE AND METHOD OF PREPARATION

[75] Inventors: Theodore C. Adams, Jr., Beltsville; Horst G. Adolph, Silver Spring, both of Md.

[73] Assignee: The United States of America as represented by the Secretary of the Navy, Washington, D.C.

[21] Appl. No.: 626,510

[22] Filed: Jun. 29, 1984

[51] Int. Cl.[4] ..... C07C 111/00; C07C 69/63; C06B 25/34

[52] U.S. Cl. ..... 564/111; 149/92; 560/227; 560/251; 562/605; 562/607

[58] Field of Search ..... 560/227, 251; 564/111

[56] References Cited

U.S. PATENT DOCUMENTS

| | | | |
|---|---|---|---|
| 2,856,420 | 10/1958 | Crawford, Jr. | 560/227 |
| 2,987,549 | 6/1961 | Feuer et al. | 564/111 |
| 3,000,957 | 9/1961 | Gold et al. | 564/111 |
| 3,000,958 | 9/1961 | Gold et al. | 564/111 |
| 3,066,169 | 11/1962 | Feuer et al. | 564/111 X |
| 3,160,654 | 12/1964 | Conly | 560/227 X |
| 3,248,420 | 4/1966 | Linden | 560/251 |

OTHER PUBLICATIONS

*Chemical Abstracts*, vol. 76, Abstract No. 126338d, 1972; Gareev et al., "Reactions of 1-acetoxy-2-nitro-2-azapropane".

*Chemical Abstracts*, vol. 87, Abstract No. 133780x, 1977; Ivshin et al.

*The Merck Index*, 1976, pp. 8-9, No. 56.

Groggins, ed., *Unit Processes in Organic Synthesis*, 4th Ed., 1952, pp. 596-609, 616-619.

*Primary Examiner*—Natalie Trousof

*Assistant Examiner*—Patricia M. Scott

*Attorney, Agent, or Firm*—Robert F. Beers; Kenneth E. Walden; Roger D. Johnson

[57] ABSTRACT

1-Fluoro-1,1,5-trinitro-3-oxa-5-azahexane which is prepared by reacting one mole of 2-fluoro-2,2-dinitroethanol with one mole of an acetate of the formula

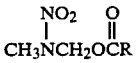

wherein R is $-CF_3$ or $CH_3$.

4 Claims, No Drawings

1-FLUORO-1,1,5-TRINITRO-3-OXA-5-AZAHEXANE AND METHOD OF PREPARATION

BACKGROUND OF THE INVENTION

This invention relates to ethers and more specifically to nitro substituted ethers which are useful as energetic plasticizers.

Two important state-of-the-art high energy plasticizers which have been and are being used in energetic compositions are nitroglycerin (NG) and bis(2,2,2-fluorodinitroethyl) formal (FEFO). While these materials represent the best compromise among available plasticizers, they have many undesirable properties such as high volatility, high melting point, modest plasticizing ability, high toxicity, high sensitivity, and, in part, low thermal stability and high cost.

It would be desirable therefore to provide a new, improved energetic plasticizer compound.

SUMMARY OF THE INVENTION

Accordingly, an object of this invention is to provide a new energetic compound.

Another object of this invention is to provide a new energetic plasticizer for explosives and propellants.

A further object of this invention is to provide a high energy plasticizer which is more chemically and thermally stable than nitroglycerin.

Yet another object of this invention is to provide an energetic plasticizer which is less volatile than nitroglycerin.

These and other objects of this invention are achieved by providing, 1-fluoro-1,1,5-trinitro-3-oxa-5-azahexane which is prepared by reacting one mole of an acetate of the formula

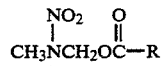

wherein B is $-CF_3$ or $-CHH_3$ with one mole of 2-fluoro-2,2-oinitroethanol.

DETAILED DESCRIPTION OF THE PREFERRED EMBODIMENT

1-Fluoro-1,1,5-trinitro-3-oxa-5-azahexane has fundamental properties similar to those of bis(2-fluoro-2,2-dinitroethyl) formal (FEFO) and nitroglycerin (NG). Thus it has a melting point of 13°–14° C., a density of 1.52 g/cm$^3$, and an estimated heat of formation of −100 kcal/mol. However, this new compound is more thermally and chemically stable than nitroglycerin, and less volatile. Since 1-fluoro-1,1,5-trinitro-3-oxa-5-azahexane contains only one fluorodinitromethyl group per molecule, it is less expensive than bis(2-fluoro-2,2-dinitroethyl) formal and probably less toxic.

It is believed that 1-fluoro-1,1,5-trinitro-3-oxa-5-azahexane will have better plasticizing properties than bis(2-fluoro-2,2-dinitroethyl) formal or nitroglycerin due to the presence of different energetic moieties, and provide better wetting of nitramine fillers by the binder of which it is a component. In addition to being a useful plasticizer in its own right, the title compound can be used in admixture with other plasticizers to provide combinations of low melting point. A typical example is the eutectic mixture of 1-fluoro-1,1,5-trinitro-3-oxa-5-azahexane and bis(2-fluoro-2,2-dinitroethyl) formal, the estimated properties of which are as follows:

Composition: 1:1 (mol/mol)
M.P.: −5° C.
$\rho o$: 1.56 g/cm$^3$
$P_J$: 240 kbar.

1-Fluoro-1,1,5-trinitro-3-oxa-5-azahexane can be prepared by reacting one mole of 2-fluoro-2,2-dinitroethanol with one mole of 2-nitro-2-azapropyl acetate in the presence of a Lewis acid catalyst. Minimization of side reaction is possible by conducting this reaction at low temperatures, preferably from −10° C. to 20° C. and more preferably from −5° C. to 10° C., and keeping the reaction time short by using a large amount of Lewis acid catalyst. The preferred Lewis acid catalyst is boron trifluoride. The preferred solvent is dichloromethane, but other inert halocarbon solvents may also be used. Example 2 illustrates this synthesis of 1-fluoro-1,1,5-trinitro-3-oxa-5-azaheptane using 2-nitro-2-azapropyl acetate.

A preferred method of preparing 1-fluoro-1,1,5-trinitro-3-oxa-5-azahexane is to react one mole of 2-fluoro-2,2-dinitroethanol with one mole of 2-nitro-2-azapropyl trifluoroacetate. The reaction is run in a polar solvent, preferably acetonitrile. No catalyst is needed. This reaction is run at a temperature of from 0° C. to 40° C., preferably at a temperature of from 20° C. to 25° C., under a vacuum which removes the trifluoroacetic acid generated by the reaction. Example 4 illustrates this reaction.

The 2-nitro-2-azapropyl trifluoroacetate is prepared by reacting one mole of trifluoroacetic anhydride with one mole of 1-hydroxy-2-nitro-2-azapropane. The preferred reaction temperature is from about −5° C. to about 0° C. A suitable halocarbon solvent such as dichloromethane is used as the solvent. Example 3 illustrates this reaction.

The general nature of the invention having been set forth, the following examples are presented as specific illustrations thereof. It will be understood that the invention is not limited to these specific examples but is susceptable to various modifications that will be recognized by one of ordinary skill in the art.

The starting material 2-nitro-2-aza-1-propanol was prepared by the following method quoted from G. A. Graneev et al, *Zhur. Org. Khim (Engl. Transl)* 7, 1971, p. 631.

"To 52.5 ml of 32% formaldehyde we added 30.4 g of methylnitroamine. The mixture was stirred for 1 hour at 20° C., and the product was extracted with methylene chloride (3×50 ml). The extract was dried with magnesium sulfate and evaporated under vacuum. The colorless liquid which remained was . . . [2-nitro-2-aza-1-propanol]. The yield was 41.6 g (98%), $d^{20}{}_4$ 1.3083, $n^{20}{}_D$ 1.4720, $MR_D$22.69 (calculated 22.42). IR spectrum, cm$^{-1}$: 1535 and 1550 ($NN0_2$), 3545 (OH). The liquid crystallized on standing in the cold. The crystals melted at 33°–34° C. Found %: C 22.80, H 6.10, N 26.50. $C_2H_6N_2O_3$. Calculated %: C 22.64, H 5.66, N 26.42."

EXAMPLE 1

2-nitro-2-azapropyl acetate (prior art method)

To a stirred mixture of 10.6 g of 2-nitro-2-azapropanol and 25 ml of dichloromethane under a nitrogen atmosphere was added dropwise and with ice-cooling 12 g of acetyl chloride. The cooling bath was removed and the mixture was slowly heated to reflux.

After 3 hours the solution was allowed to cool and was then triturated with 50 ml of ice water. The organic phase was separated, dried (MG $SO_4$), and distilled. The product 2-nitro-2-azapropyl acetate had b.p. 56°–57° C. at 0.07 mm Hg.

EXAMPLE 2

1-fluoro-1,1,5-trinitro-3-oxa-5-azahexane prepared from 2-nitro-2-azapropyl acetate 2-Fluoro-2,2-dinitroethanol (9.86 g, 64.0 mmol) and 2-nitro-2-azapropyl acetate (8.88 g, 60.0 mmol) in dichloromethane (30 ml) were stirred under nitrogen at 0° C. to 5° C. Boron trifluoride etherate (7.52 ml, 8.46 g, 60 mmol) was added during 5 minutes, and stirring was continued for 70 minutes. The mixture was then poured on to a saturated solution of sodium chloride (10 ml/mmol). The yield was 10 g of an oil.

Chromatography on 350 g silica gel (Merck, Kieselgel 40) eluting with 3:2 dichloromethane/hexane to dichloromethane gave 1-fluoro-1,1,5-trinitro-3-oxa-5-azahexane; yield: 4.5 gm (31%). Recrystallization from ether/hexane at −78° C. gave 1-fluoro-1,1,5-trinitro-3-oxa-5-azahexane; yield: 4.1 gm (28%); m.p. 13.0°–14.2° C.

H-N.M.R. ($CDCl_3/TMS_{intl}$): $\delta=3.5$ (s, 3 H); 4.87 (d, J=19 Hz, 2 H); 5.4 ppm (s, 2 H).

EXAMPLE 3

2-nitro-2-azapropyl trifluoroacetate

Trifluoroacetic anhydride (20 ml, 103.6 g, 0.49 moles) was added to a stirred solution of 1-hydroxy-2-nitro-2-azapropane (40.0 g, 0.38 moles) in dichloromethane (60 ml) at −5° to 0° C. during 1½ hours. The resulting solution was then distilled without warming at 20 mm, then to 3 mm. The product was distilled at 1.5 mm, 65° C. to give 2-nitro-2-azapropyl trifluoroacetate; yield: 48 g (63%).

$^1$H-N.M.R. ($CDCl_3/TMS_{int}$): $\delta=3.58$ (s, 3 H), 6.08 ppm (s, 2 H).

EXAMPLE 4

1-fluoro-1,1,5-trinitro-3-oxa-5-azahexane prepared from 2-nitro-2-azapropyl trifluoroacetate 2-Fluoro-2,2-dinitroethanol (7.62 g, 49.5 mmol) was stirred with acetonitrile (2.5 ml) under nitrogen as 2-nitro-2-azapropyl trifluoroacetate (10.0 g, 49.5 mmol) in acetonitrile (3.5 ml) was added in one portion. The reaction flask was immediately connected to a vacuum pump and brought to 1–2 mm during several minutes. After stirring 2⅔ hours, the solution was stirred ⅓ hour at ambient pressure before pouring onto a saturated sodium chloride solution (50 ml), which was extracted with dichloromethane (3×25 ml). The organic portion was washed with a 1:1 mixture of saturated sodium chloride solution: 0.04 N sodium hydroxide solution (10×150 ml), dried with magnesium sulfate, and concentrated to crude 1-fluoro-1,1,5-trinitro-3-oxa-5-azahexane; yield: 8.67 g (72%). Recrystallization from ether/hexane at −78° C. gave 1-fluoro-1,1,5-trinitro-3-oxa-5-azahexane; yield: 7.5 g (63%).

$^1$H-N.M.R. ($CDCl_3/TMS_{int}$) : $\delta$3.5 (s, 3 H); 4.87 (d, J=19 Hz, 2 H); 5.4 ppm (s, 2 H).

Obviously, numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. 1-fluoro-1,1,5-trinitro-3-oxa-5-azahexane.

2. A method of preparing 1-fluoro-1,1,5-trinitro-3-oxa-5-azahexane comprising:

(1) reacting one mole of 2-nitro-2-azapropyl trifluoroacetate with one mole of 2-fluoro-2,2-dinitroethanol in a polar solvent at a temperature of from 0° C. to 40° C. to form 1-fluoro-1,1,5-trinitro-3-oxa-5azahexane, wherein the reaction is run under vacuum to remove trifluoroacetic acid generated by the reaction; and (2) isolating the product 1-fluoro-1,1,5-trinitro-3oxa-5-azahexane.

3. The method of claim 2 wherein the reaction is run at a temperature of from 20° C. to 25° C.

4. The method of claim 2 wherein the polar solvent is acetonitrile.

* * * * *